United States Patent [19]

Christensen et al.

[11] Patent Number: 4,756,364

[45] Date of Patent: Jul. 12, 1988

[54] PACKER BYPASS

[75] Inventors: Jon B. Christensen; Harold K. Beck; Vincent P. Zeller, all of Duncan, Okla.

[73] Assignee: Halliburton Company, Duncan, Okla.

[21] Appl. No.: 940,882

[22] Filed: Dec. 10, 1986

[51] Int. Cl.[4] ..... E21B 33/124

[52] U.S. Cl. ..... 166/101; 166/106; 166/186; 166/187; 166/237

[58] Field of Search ..... 166/101, 106, 129, 133, 166/184, 185, 186, 187, 323, 332, 237

[56] References Cited

U.S. PATENT DOCUMENTS

| | | | |
|---|---|---|---|
| 2,690,224 | 9/1954 | Roberts | 166/120 |
| 2,978,046 | 4/1961 | True | 166/187 |
| 3,083,774 | 4/1963 | Peters et al. | 166/187 |
| 3,291,219 | 12/1966 | Nutter | 166/145 |
| 3,387,659 | 6/1968 | Current | 166/237 |
| 3,439,740 | 4/1969 | Conover | 166/250 |
| 3,876,000 | 4/1975 | Nutter | 166/106 |
| 3,876,003 | 4/1975 | Kisling III | 166/250 |
| 3,926,254 | 12/1975 | Evans | 166/106 |
| 4,246,964 | 1/1981 | Brandell | 166/106 |
| 4,278,130 | 7/1981 | Evans et al. | 166/332 |
| 4,320,800 | 3/1982 | Upchurch | 166/106 |
| 4,366,862 | 1/1983 | Brandell | 166/106 |
| 4,368,911 | 1/1983 | Pringle | 166/98 |
| 4,372,387 | 2/1983 | Brandell | 166/334 |
| 4,386,655 | 6/1983 | Brandell | 166/106 |
| 4,388,968 | 6/1983 | Brandell | 166/236 |
| 4,412,584 | 11/1983 | Brandell | 166/169 |
| 4,415,038 | 11/1983 | Schmuck | 166/332 |
| 4,457,367 | 7/1984 | Brandell | 166/105 |
| 4,458,752 | 7/1984 | Brandell | 166/187 |
| 4,605,064 | 8/1986 | Akkerman | 166/237 |

OTHER PUBLICATIONS

Halliburton Services Sales and Service Catalog No. 43, pp. 2537–2538.

Oilweek, Sep. 1, 1980, edition, p. 11—Northstar Drillstem Testers, Ltd.

Lynes Product No. 304–40, pp. 3964–3966, of Lynes Catalog.

Johnston-Schlumberger Inflatable Packer Testing System shown in Johnston/Schlumberger Form J-432.

*Primary Examiner*—Jerome Massie, IV

*Assistant Examiner*—Terry Lee Melius

*Attorney, Agent, or Firm*—James R. Duzan; Neal R. Kennedy

[57] ABSTRACT

A packer bypass for use between a pump and packer in a testing string for venting said pump and packer to a well annulus after completion of a testing operation. The packer bypass comprises a case with an inner flow tube disposed therein such that an annular passageway is defined therebetween. A piston having a lower portion is reciprocably disposed in the annular passageway. A plurality of latching fingers are pivotally mounted to the lower end of the piston and biased towards a latching position. A bypassing mandrel is reciprocably disposed in the annular passageway below the piston and has an open position for bypassing pump pressure thereabove and packer pressure therebelow to the well annulus and also has a closed position in which bypassing is prevented. The mandrel may be raised from the closed position to the open position by lowering the piston and engaging the latching fingers with a flange on the mandrel. When the mandrel is moved to the open position, the latching fingers are automatically released. The mandrel may be pumped back to the closed position for another test. Hydraulic pressure across the mandrel prevents overpull, and pressure balancing on the piston prevents undesired downward force on the packer.

12 Claims, 8 Drawing Sheets

PACKER BYPASS

BACKGROUND OF THE INVENTION

1. Field Of The Invention

The present invention relates to bypass devices for relieving pressure on inflatable packers in a tool string, and more particularly, to a packer bypass having a bypassing mandrel therein which can be reset for reinflating the packers.

2. Description Of The Prior Art

In testing a well formation, a testing string is lowered into a well bore such that a packer is positioned above and below the formation to be tested. The packers are typically of the inflatable type and a pump in the testing string is actuated for pumping fluid to inflate the packers into sealing engagement with the well bore for isolation of the formation. When testing is completed, it is necessary to bypass or vent the fluid in the packers back to the well annulus so that the testing string may be moved to a different location in the well bore or removed therefrom.

A typical packer used is the Halliburton Hydroflate® packer, manufactured by the assignee of the present invention, and disclosed in Halliburton Services Catalog 43, pages 2537–2538. The pump previously used with this packer has a built-in packer bypass which releases fluid from the packers when pull is exerted on the bypass from the surface.

A tester valve is used which also requires manual manipulation from the surface, and a problem with the previous packer bypass is that overpull on the tester valve may result in premature actuation of the packer bypass with resulting premature deflation of the packers.

The present invention solves this problem by providing a packer bypass with a mandrel having a pressure differential thereacross which requires approximately 10,000 pounds pull to actuate during a packer deflation operation. This force is greatly more than is needed to operate the tester valve. Thus, even if there is some overpull on the tester valve, premature actuation of the packer bypass is not likely to occur.

The mandrel in the packer of the present invention is automatically released when in a bypass position so that it can reclose if pump pressure is reapplied. In this way, the packer bypass may be used for sequential tests with the testing string.

SUMMARY OF THE INVENTION

The packer bypass of the present invention is used to vent fluid from an inflatable packer used in a testing string so that the packer will deflate, allowing movement of the testing string within the well bore. The packer bypass comprises case means defining a central opening therethrough, piston means reciprocably disposed in the central opening of the case means and movable between a first position and a second position, mandrel means disposed in the central opening of the case means and having a bypass position for providing communication between the packer and a well annulus and the mandrel means further having a sealed position preventing communication between the packer and the well annulus, and latching means in operative association with the piston means for latchingly engaging the mandrel means when the mandrel is in the sealed position and the piston means is in the second position. After latching, the mandrel means may be moved from the sealed position to the bypass position thereof by moving the piston means from the second position to the first position. Releasing means are preferably provided for disengaging the latching means and releasing the mandrel means when in the bypass position. The mandrel means may be moved back from the bypass position to the sealed position in response to a differential pressure between the pump and well annulus acting across a differential area defined by a portion of the mandrel means.

The packer bypass also includes overpull prevention means for preventing actuation of the piston until a predetermined termined force is overcome. The overpull prevention means is characterized by annular shoulder means on the mandrel means, and the shoulder means is exposed to pump pressure on one side thereof and well annulus pressure on an opposite side thereof, resulting in a predetermined force acting on the mandrel means which must be overcome before the mandrel means can be moved to the bypass position.

Pressure balancing means is also preferably included in the packer bypass for balancing pressure between the case means and the piston means for minimizing downward force on the packer. The pressure balancing means comprises a recess defined in the case means and annular shoulder means on the piston means extending into the recess such that a cavity is formed therebetween with an upper portion in communication with the pump and the lower portion in communication with the well annulus.

In the preferred embodiment, the packer bypass further comprises inner flow tube means disposed in the case means such that an annular flow passageway is defined between the case means and flow tube means. The piston means has an annular portion disposed in the flow passageway, and the mandrel means is characterized by a generally annular mandrel disposed in the flow passageway.

The latching means comprises a releasable latch assembly with at least one latch pivotally attached to the lower portion of the piston means. The latch comprises a lower end having a latching position and a release position and biasing means for biasing the lower end of the latch toward the latching position. The latch is preferably one of a plurality of angularly spaced latches, and the biasing means includes at least one garter spring disposed around the latches. The releasing means comprises a tapered surface in the case means for engaging an upper end of the latch and pivoting the lower end of the latch to the released position.

Sealing means are provided for sealing between the mandrel means and the flow tube means when the mandrel means is in the bypass position such that the flow passageway is separated into upper and lower portions. The mandrel means comprises check valve means for venting the upper portion of the flow passageway through a bypass passageway in the mandrel means when a differential pressure between the upper portion of the flow passageway and the well annulus exceeds a predetermined level.

The packer bypass of the present invention forms a portion of a downhole testing tool which includes a pump attached to an upper testing string portion and an inflatable packer disposed below the pump and positionable adjacent the well formation to be tested. The packer bypass is disposed between the pump and packer and allows communication between the pump and packer when the mandrel means is in the sealed position and vents the pump through the upper portion of the flow passageway to the well annulus and vents the packer through the lower portion of the flow passageway to the well annulus when the mandrel means is moved to the open position.

An important object of the present invention is to provide a packer bypass having a bypass mandrel therein which may be selectively positioned between a bypass position for venting a packer to a well annulus and a sealed position preventing such venting.

Another object of the invention is to provide a packer bypass with a bypass mandrel having a differential area thereon such that the mandrel may not be moved to a bypass position unless an upward force thereon exceeds a downward force on the mandrel due to a differential pressure between a flow passageway above the mandrel and a well annulus acting across the differential area.

Still another object of the invention is to provide a packer bypass with releasable latching means therein for latchingly engaging a bypass mandrel in a closed position, whereby the mandrel may be moved to an open position and released.

An additional object is to provide a packer bypass which will automatically reset to a closed position in response to pump pressure.

Still another object of the invention is to provide a downhole testing tool having a pump and an inflatable packer with a packer bypass disposed between the pump and packer for allowing communication between the pump and packer when the packer bypass is in a closed position and venting the pump and packer to a well annulus when the packer bypass is in an open position.

Additional objects and advantages of the invention will become apparent as the following detailed description of the preferred embodiment is read in conjunction with the drawings which illustrate such preferred embodiment.

BRIEF DESCRIPTION OF THE DRAWINGS

FIGS. 6A–6D show the packer bypass of the present invention in a position in which a piston therein is latched to a bypass mandrel and ready for actuation from the closed position to the open position.

DESCRIPTION OF THE PREFERRED EMBODIMENT

Figure 1A:
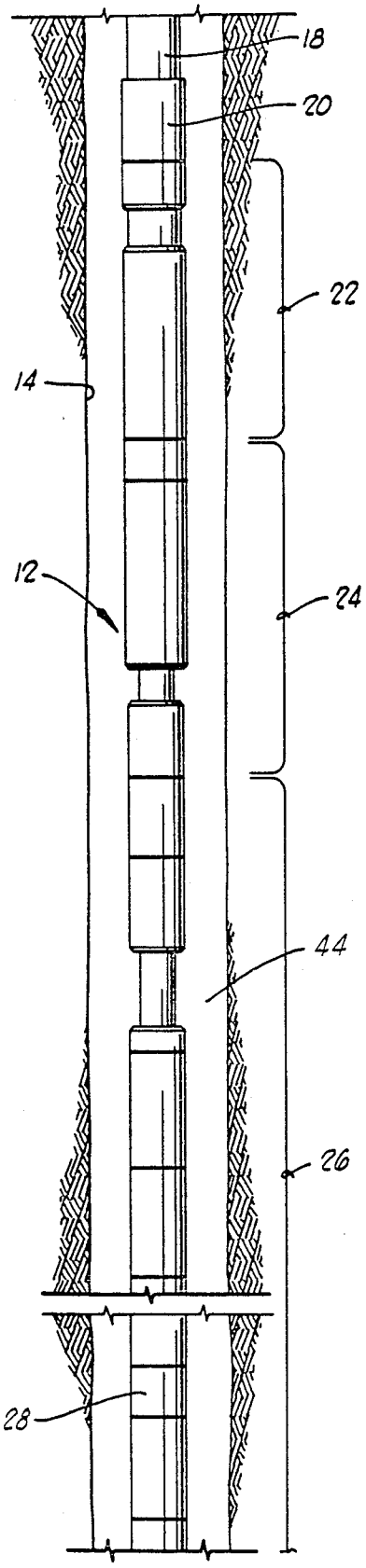
FIGS. 1A–1B show the packer bypass of the present invention as part of a testing string in position in a well bore for testing a well formation.
Figure 1B:
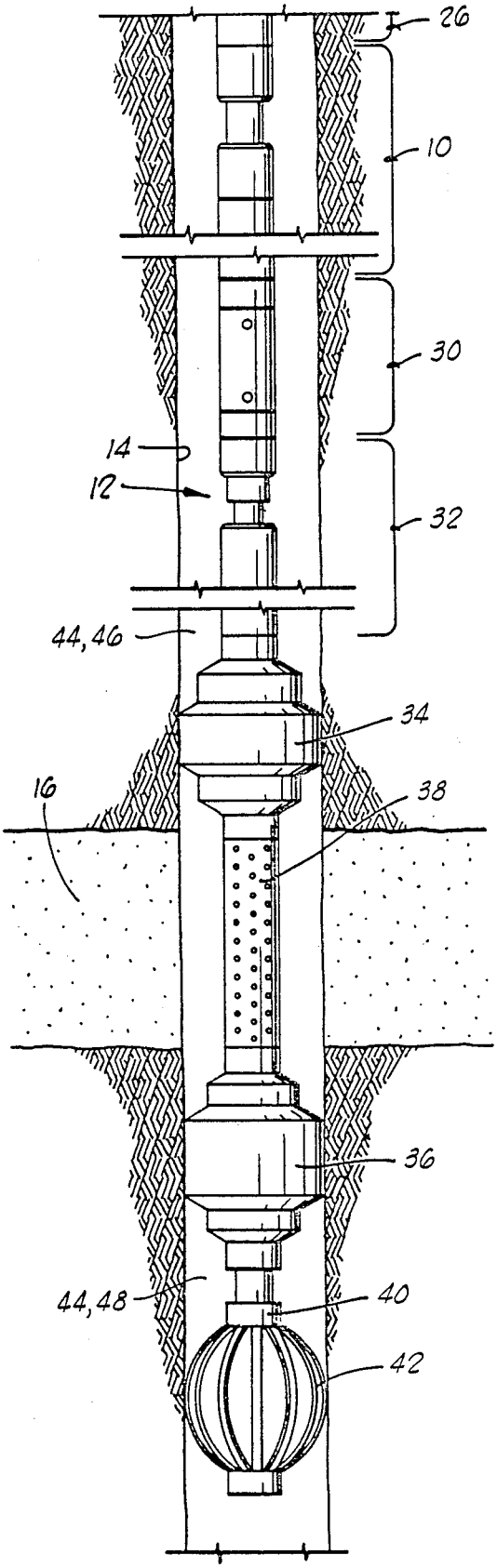

Referring now to the drawings, and more particularly to FIGS. 1A–1B, the packer bypass of the present invention is shown and generally designated by the numeral 10. Packer bypass 10 forms a part of a testing apparatus or tool 12. Testing apparatus is shown in position in a well bore 14 for use in testing a well formation 16.

Testing apparatus 12 is attached to the lower end of the tool string 18 and includes a reversing sub 20, a tester valve 22 such as the Halliburton Hydrospring® tester, an extension joint 24, and a pump 26 of a type having a pressure limiter means 28, all of which are positioned above packer bypass 10.

Disposed below packer bypass 10 is a string bypass 30 and a safety joint 32. An upper packer 34 is attached to the lower end of safety joint 32 and is disposed above well formation 16. String bypass 30 is used for bypassing fluid around upper packer 34 as tool string 18 is lowered into, or raised out of, well bore 14. A lower packer 36 is positioned below well formation 16. A porting sub 38 interconnects upper packer 34 and lower packer 36. Spacers (not shown) may also be used between upper packer 34 and lower packer 36 depending upon the longitudinal separation required therebetween.

Pump 26 is preferably a positive displacement pump and is used to inflate upper packer 34 and lower packer 36 in a manner known in the art such that the packers may be placed in sealing engagement with well bore 14, thus isolating well formation 16 as shown in FIGS. 1A–1B so that a testing operation may be carried out.

A gauge carrier 40 is attached to the lower end of lower packer 36 and includes a plurality of drag springs 42 which are adapted to engage well bore 14 and prevent rotation of a portion of testing apparatus 12 during inflation of upper packer 34 and lower packer 36.

A well annulus 44 is defined between testing apparatus 12 and well bore 14, and when upper packer 34 and lower packer 36 are inflated into sealing engagement with well bore 14, it will be seen that well annulus 44 is divided into an upper portion 46 above upper packer 34 and a lower portion 48 below lower packer 36. Both upper portion 46 and lower portion 48 of well annulus 44 are sealingly separated from well formation 16 by the packers.

Referring now to FIGS. 2A–2D, packer bypass 10 is shown in a closed, sealed position. This is preferably the position in which the apparatus is set as testing apparatus 12 is lowered into well bore 14. However, as will be further discussed herein, packer bypass 10 may also be run into well bore 14 in an open, bypass position.

The major components of packer bypass 10 include a case means 50 with a central opening 52 therethrough, mandrel means 54 disposed in a lower end of central opening 52, and piston means 56 having a lower portion reciprocably disposed in central opening 52 of case means 50 above mandrel means 54.

Figure 2A:
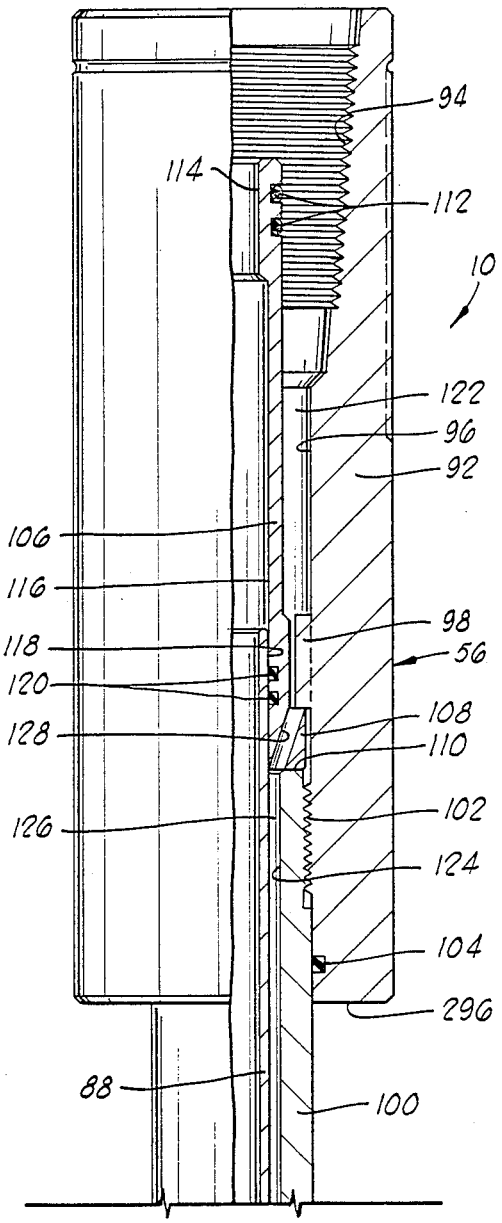
FIGS. 2A–2D show a partial longitudinal cross section of the packer bypass in a closed, sealed position.
Figure 2B:
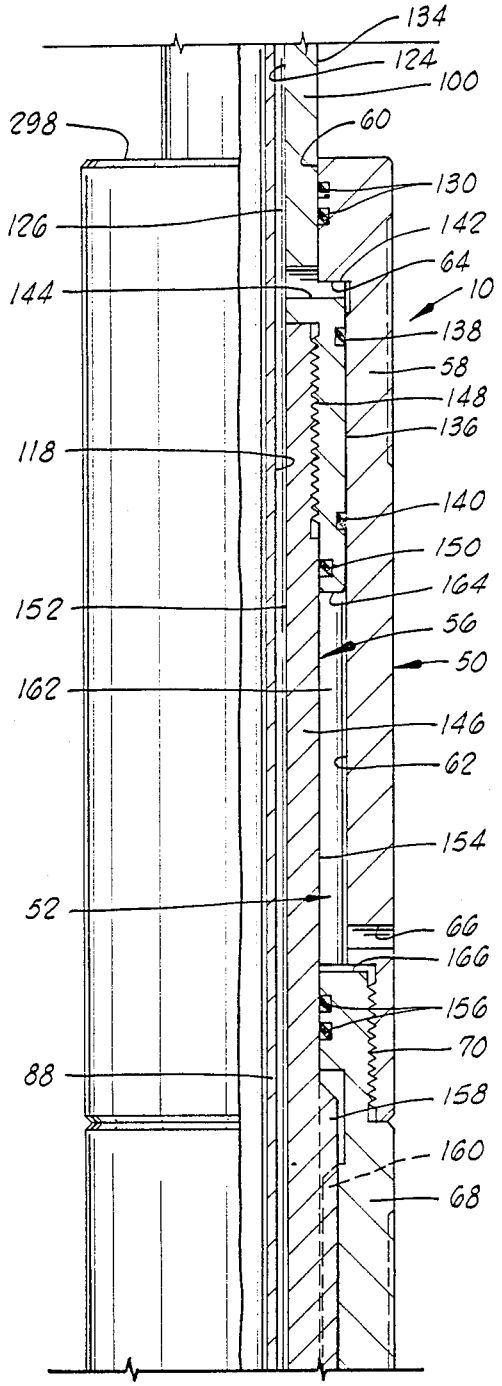

Referring to FIG. 2B, the upper end of case means 50 is formed by a hydraulic case 58 having an upper end with a first bore 60 therein. Hydraulic case 58 also has a second bore 62 outwardly spaced from first bore 60. A downwardly facing, annular shoulder 64 extends between first bore 60 and second bore 62. A transverse hole 66 provides communication between second bore 62 and well annulus 44.

The lower end of hydraulic case 58 is connected to an upper end of a splined nipple 68 at threaded connection 70.

Figure 2C:
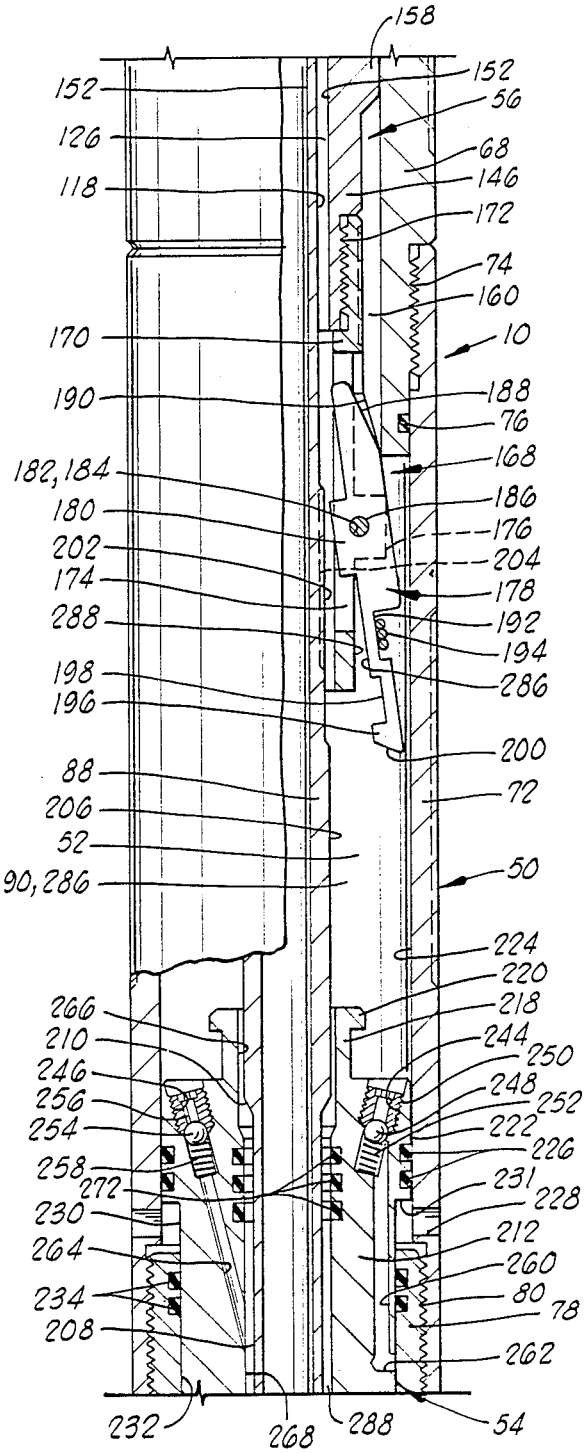

Referring now to FIG. 2C, the lower end of splined nipple 68 is connected to bypass case 72 at threaded connection 74. Seal 76 insures sealing engagement between splined nipple 68 and bypass case 72.

The lower end of bypass case 72 is connected to the upper end of bottom adapter 78 at threaded connection 80.

Figure 2D:
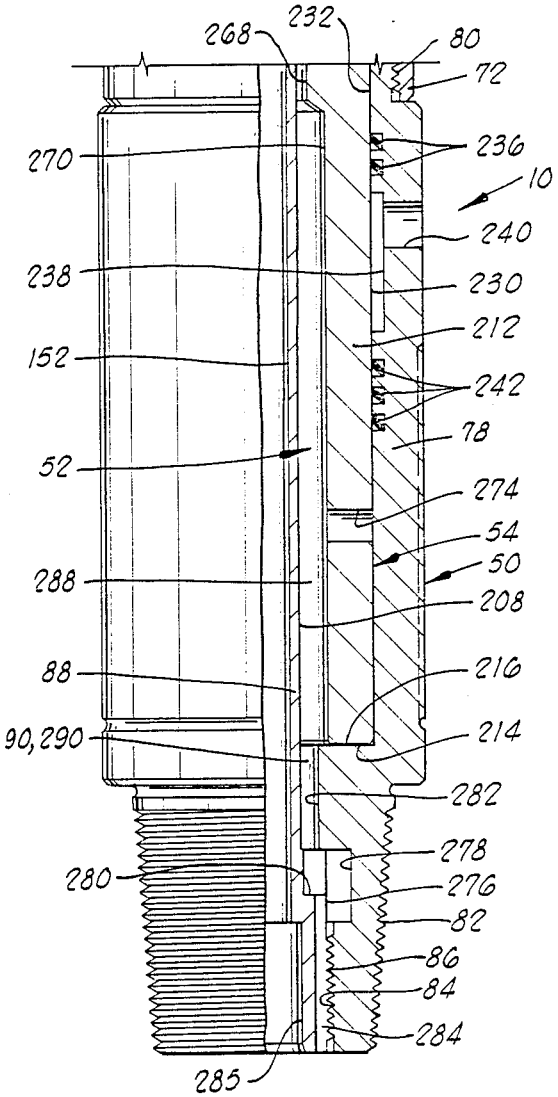

As shown in FIG. 2D, bottom adapter 78 has an externally threaded lower end 82 which is adapted for connection to the portion of testing string 12 below packer bypass 10. The lower end of bottom adapter 78 also has an internally threaded portion 84 into which is threadedly engaged the lower end 86 of inner flow tube 88.

Inner flow tube 88 acts as an inner flow tube means and extends through the entire length of packer bypass 10 including central opening 52 of case means 50. As shown in FIGS. 2A and 2B, inner flow tube 88 extends upwardly and outwardly of the case means into piston means 56. It will be seen in FIGS. 2B–2D that case means 50 and inner flow tube 88 define a generally annular flow passageway 90 therebetween. Thus, mandrel means 54 and the substantially annular lower end of piston means 56 are disposed in annular passageway 90.

Referring again to FIGS. 2A and 2B, the upper end of piston means 56 includes a top adapter 92 having an internally threaded portion 94 adapted for attachment to the portion of testing apparatus 12 which is above packer bypass 10. Top adapter 92 has a central bore 96 therein with a plurality of lugs 98 extending radially inwardly therefrom. The lower end of top adapter 92 is connected to hydraulic piston 100 at threaded connection 102. A seal 104 provides sealing between top adapter 92 and hydraulic piston 100.

Positioned above hydraulic piston 100 in top adapter 92 is an upper seal mandrel 106. The lower end of seal mandrel 106 includes a radially outwardly extending flange 108 which is longitudinally positioned between lugs 98 in top adapter 92 and upper end 110 of hydraulic piston 100. The upper end of seal mandrel 106 includes seals 112 and is adapted for engagement with a mandrel (not shown) of a kind known in the art which is in the portion of testing apparatus 12 above packer bypass 10.

Upper seal mandrel 106 has a first bore 114 through the upper end thereof and a second bore 116 outwardly spaced from first bore 114. Second bore 116 is in close, spaced relationship with first outside diameter 118 of inner flow tube 88. Seals 120 provide sliding, sealing engagement between upper seal mandrel 106 and inner flow tube 88.

It will be seen that upper seal mandrel 106 is spaced inwardly from central bore 96 of top adapter 92 such that an annular cavity 122 is defined therebetween. Similarly, first outside diameter 118 of inner flow tube 88 is spaced inwardly from central bore 124 of hydraulic piston 100 such that an annular cavity 126 is defined therebetween throughout the length of hydraulic piston 100. At least one annularly disposed hole 128 extends in a generally longitudinal direction through flange 108 of upper seal mandrel 106 and provides communication between annular cavity 122 and annular cavity 126.

Referring now to FIG. 2B, seals 130 provide sealing engagement between the upper end of hydraulic case 58 and first outside diameter 134 of hydraulic piston 100. The lower end of hydraulic piston 100 has a second outside diameter 136 which is radially outwardly spaced from first outside diameter 134 and is in close, spaced relationship with second bore 62 of hydraulic case 58. Seals 138 and 140 provide sliding, sealing engagement between hydraulic piston 100 and second bore 62 of hydraulic case 58. It will be seen that hydraulic piston 100 thus has an upwardly facing shoulder 142 between first outside diameter 134 and second outside diameter 136, and shoulder 142 faces shoulder 64 in hydraulic case 58. In the position shown in FIG. 2B, shoulder 142 is in contact with shoulder 64.

Hydraulic piston 100 has at least one substantially transverse hole 144 therethrough. In the preferred embodiment, the central axis of hole 144 is in substantially the same transverse plane as shoulder 140 on hydraulic piston 100.

The lower end of hydraulic piston 100 is attached to the upper end of splined mandrel 146 at threaded connection 148. A seal 150 provides sealing engagement therebetween.

Splined mandrel 146 has a central bore 152 therethrough which is substantially the same diameter as central bore 124 of hydraulic piston 100. Thus, it will be seen that annular cavity 126 continues below hydraulic piston 100 and along the entire length of splined mandrel 146.

Splined mandrel 146 has an outside diameter 154, and seals 156 provide sliding, sealing engagement between outside diameter 154 and the upper end of splined nipple 68. Extending radially outwardly from outside diameter 154 of splined mandrel 146 are a plurality of splines 158 which are engaged with inwardly extending splines 160 in splined nipple 68. It will be seen that the engagement of splines 158 and 160 prevents relative rotation between piston means 56 and case means 50 while allowing relative longitudinal movement therebetween.

Outside diameter 154 of splined mandrel 146 is spaced radially inwardly from second bore 62 of hydraulic case 58. Thus, a substantially annular hydraulic piston chamber 162 is defined radially between outside diameter 154 of splined mandrel 146 and second bore 62 of hydraulic case 58, and longitudinally between bottom face 164 of hydraulic piston 100 and top face 166 of splined nipple 68. Transverse hole 66 through hydraulic case 58 thus provides communication between piston chamber 162 and well annulus 44.

Referring now to FIG. 2C, a latching means, generally designated by the numeral 168, is shown. Latching means 168 includes a latching assembly mandrel 170 which is attached to the lower end of splined mandrel 146 at threaded connection 172.

Figure 3:
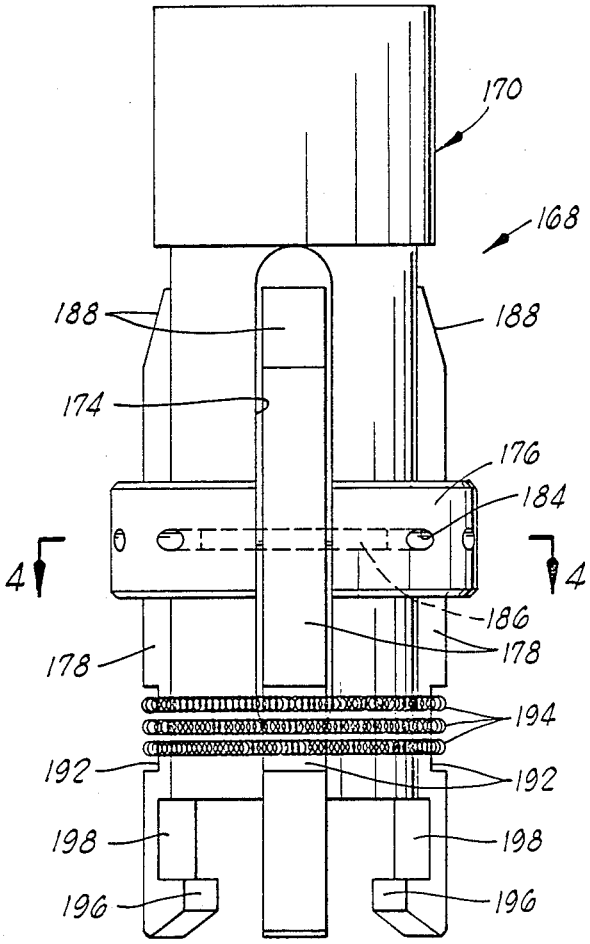
FIG. 3 is a side elevation of a latching assembly used in the packer bypass.

Referring also to FIG. 3, latching assembly mandrel 170 includes a plurality of angularly spaced, substantially longitudinal slots 174 therein. A substantially annular latch support flange 176 extends radially outwardly on latching assembly mandrel 170. It will be seen that latch support flange 176 is located at an intermediate position along slots 174, and slots 174 extend through latch support flange 176. An elongated latching finger 178 with a body portion 180 is disposed in each slot 174. In the preferred embodiment, three slots 174 and three latching fingers 178 are used. However, the apparatus is not limited to this configuration.

Figure 4:
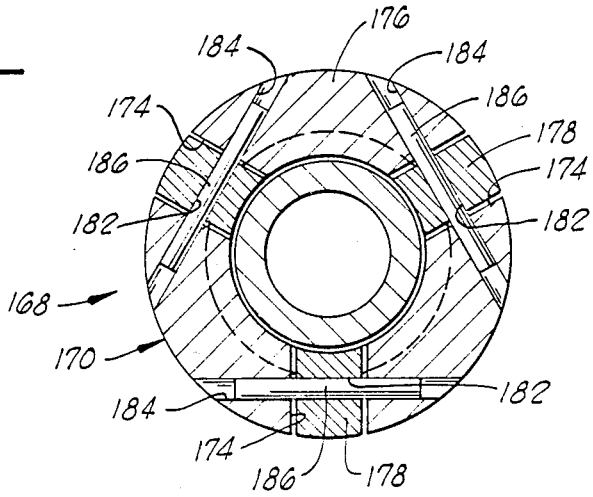
FIG. 4 is a cross section taken along lines 4—4 in FIG. 3.
Figure 5A:
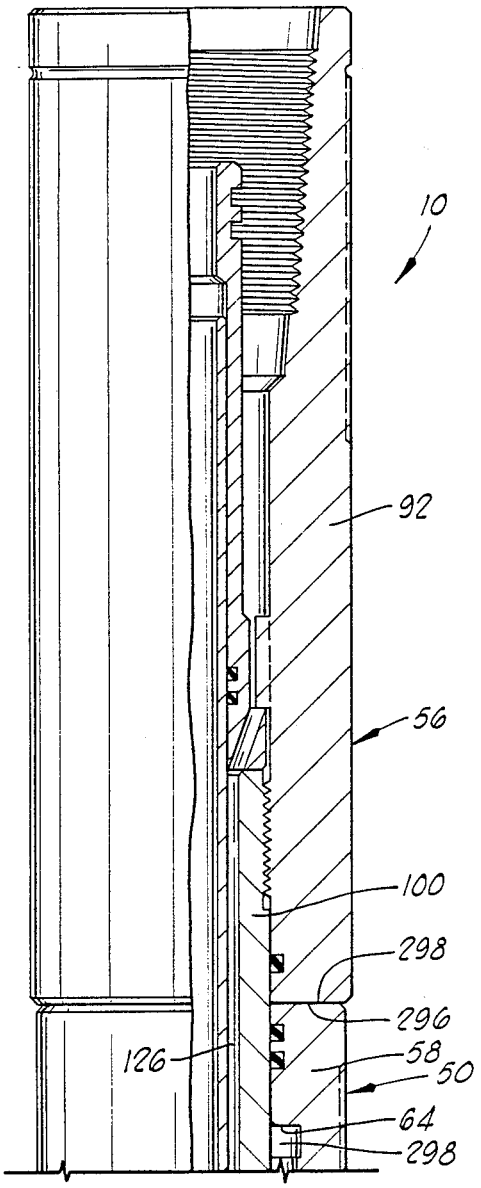
Figure 5B:
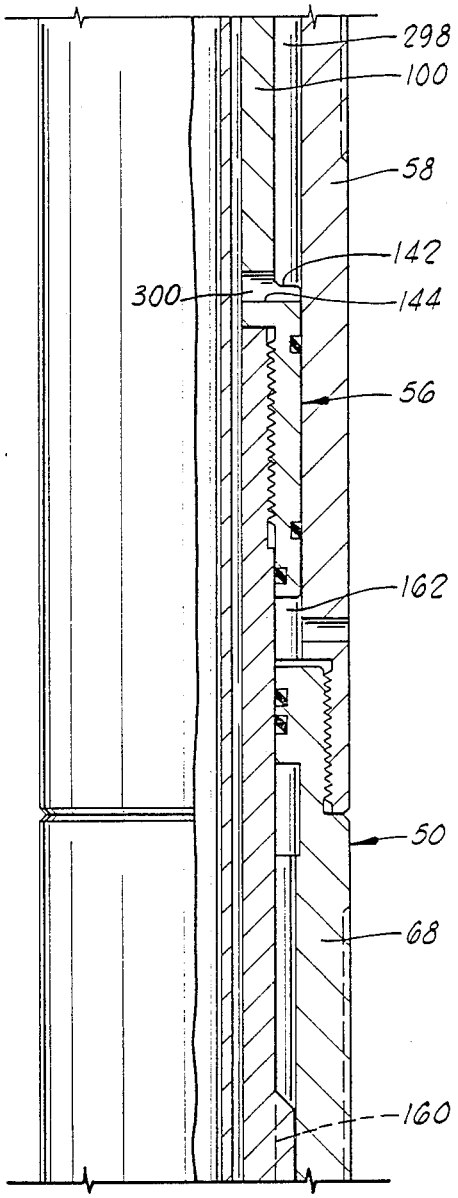
Figure 6D:
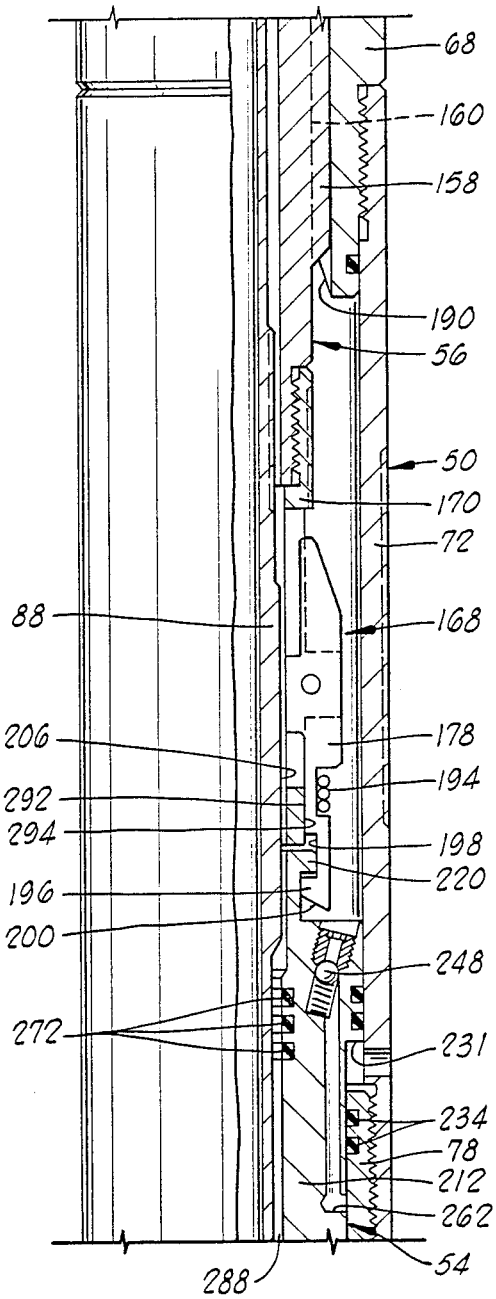
Figure 6D:
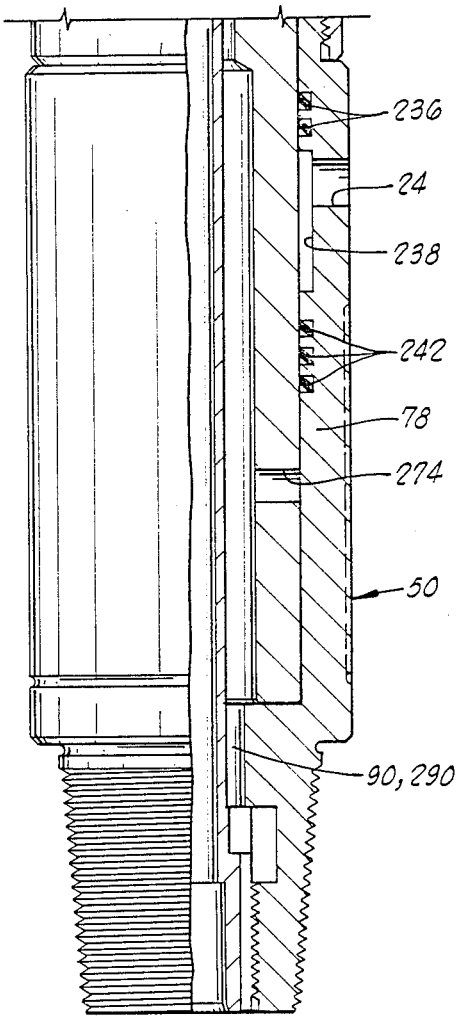
Figure 7A:
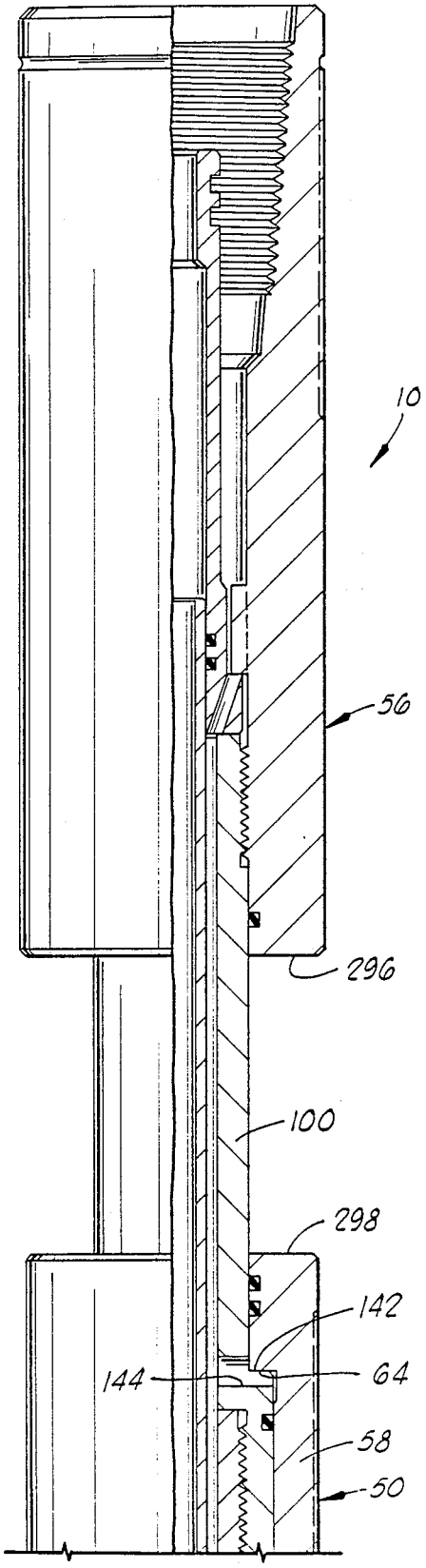
FIGS. 7A–7B show a partial longitudinal cross section of the packer bypass in an open, bypassing position.
Figure 7B:
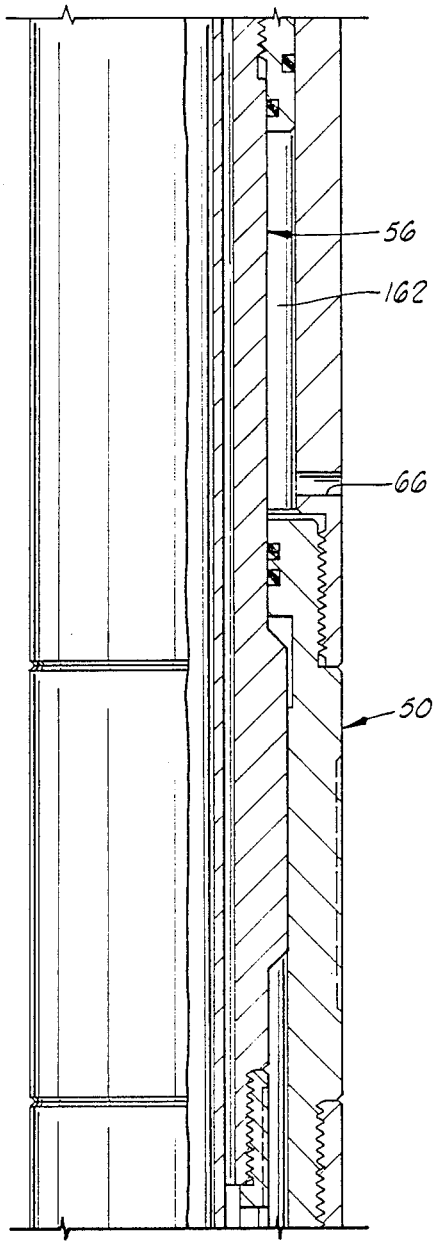
Figure 7C:
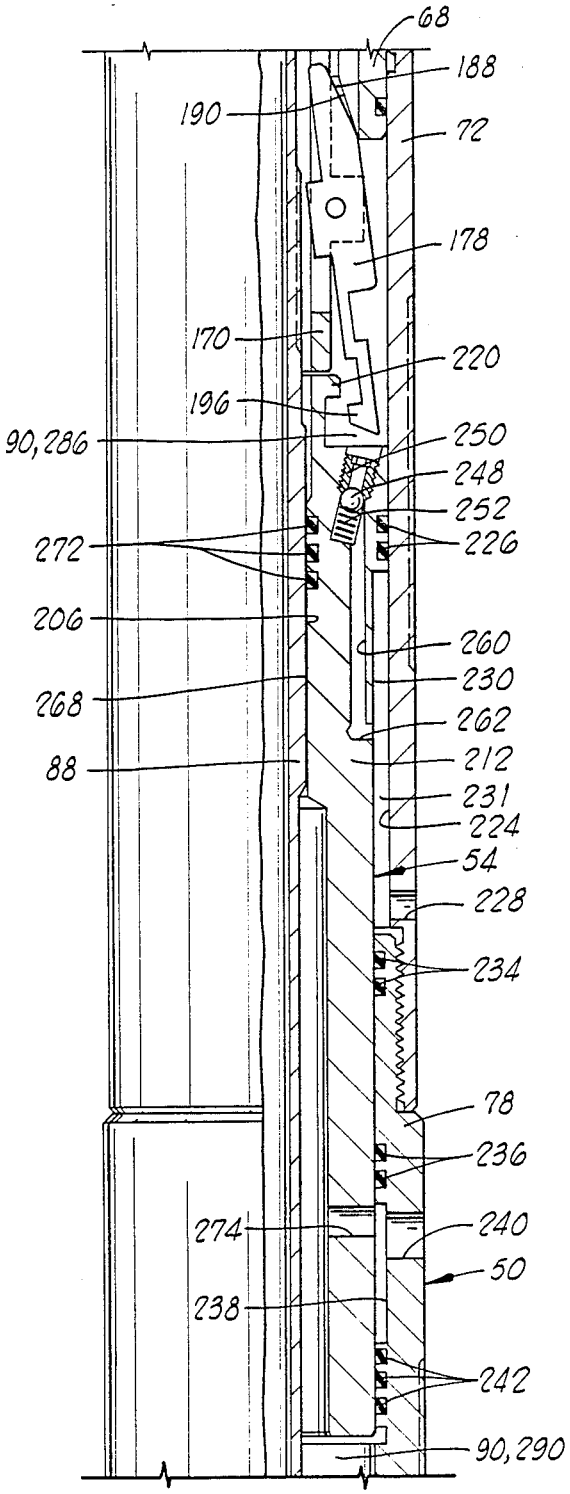
Figure 7D:
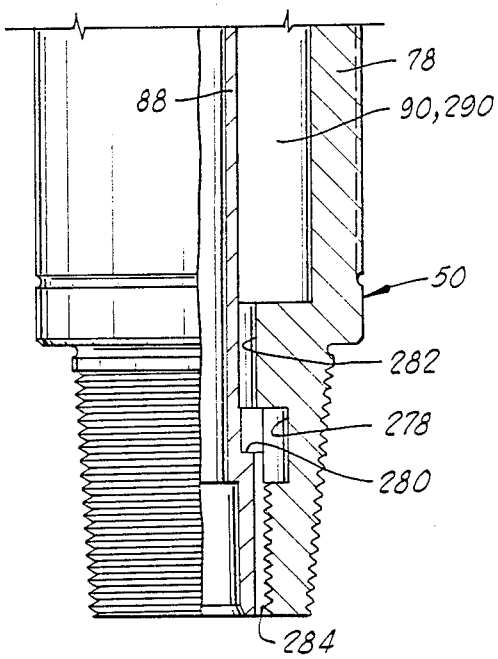

Body portion 180 of each latching finger 178 defines a hole 182 therethrough which is aligned with a pair of other holes 184 through latch support flange 176 of latching assembly mandrel 170, as best shown in FIG. 4. The central axis of each pair of holes 184 intersects flange 176 in a chord-like manner. A pivot pin 186 is disposed through each corresponding set of holes 182 and 184 such that latching finger 178 is pivotally mounted in slot 174 with pivot pin 186 defining a point of pivotation.

The upper end of each latching finger 176 above pivot pin 186 has a chamfered outer surface which tapers inwardly toward the top. In the uppermost position of piston means 56 with respect to case means 50 as shown in FIGS. 2A–2D, chamfered surface 188 of latching finger 178 engages a corresponding chamfered inner surface 190 at the lower end of splines 160 in splined nipple 68 such that the upper end of each latching finger 178 is pivoted inwardly. The lower end of each latching finger 178 below pivot pin 186 is correspondingly pivoted outwardly.

Latching finger 178 also includes an outwardly facing notch 192 below pivot pin 186. A biasing means, such as a plurality of garter springs 194, is positioned around latching fingers 178 and in notches 192 therein. It will be seen that garter springs 194 tend to bias the lower end of latching fingers 178 radially inwardly.

The lower end of each latching finger 178 has an inwardly extending latching tooth 196 with an inwardly facing notch 198 above and adjacent tooth 196. The lower side of each tooth 196, and thus of each latching finger 178, includes a tapered surface 200 which tapers inwardly toward the top.

As seen in FIGS. 2A–2C, first outside diameter 118 of inner flow tube 88 is substantially constant through the entire length of piston means 56. A second diameter 202 of inner flow tube 88 is larger than first diameter 118. Second outside diameter 202 includes a plurality of wrenching flats 204 thereon which are used when installing lower end 86 of the inner flow tube into threaded portion 84 of bottom adapter 78 of case means 50.

Inner flow tube 88 also has a third outside diameter 206 which, in the position of packer bypass 10 shown in FIGS. 2A–2D, is longitudinally located between latching means 168 and mandrel means 54. Third outside diameter 206 is shown in FIG. 2C and is larger than second diameter 202 of inner flow tube 88. Inner flow tube 88 also has a fourth outside diameter 208 which is smaller than third outside diameter 206 and extends therebelow. A downwardly facing chamfer 210 on inner flow tube 88 interconnects third outside diameter 206 and fourth outside diameter 208 thereof.

Referring again to FIGS. 2C and 2D, mandrel means 54 is preferably characterized by an elongated, substantially annular mandrel 212 which is annularly disposed between inner flow tube 88 and case means 50. In the position shown in FIGS. 2C–2D, mandrel 212 is in a lowermost position in which a lower end 214 thereof engages upwardly facing shoulder 216 in bottom adapter 78 of case means 50. It will thus be seen that when piston means 56 is in the uppermost position shown in FIGS. 2A–2D, mandrel 212 is spaced below latching fingers 178.

The upper end of mandrel 212 includes a relatively small diameter neck section 218 with a radially outwardly extending flange 220 at the top thereof. Flange 220 is adapted to be engaged by teeth 196 and notches on latching fingers 178 as hereinafter described.

Below neck portion 218, mandrel 212 has a first outside diameter 222 which is in close, spaced relationship to inner bore 224 of bypass case 72. Seals 226 insure sliding, sealing engagement between mandrel 212 and bypass case 72.

Bypass case 72 has a transverse hole 228 therethrough which is always located below seals 226, regardless of the position of mandrel 212 within case means 50.

Mandrel 212 has a second outside diameter 230 which is smaller than first outside diameter 222 such that a downwardly facing shoulder 231 is formed. Second outside diameter 230 is in close, spaced relationship to first bore 232 in bottom adapter 78. Upper seals 234 located at the upper end of bottom adapter 78 provide sealing engagement between the bottom adapter and second outside diameter 230 of mandrel 212. It will be seen that seals 234 are fixedly positioned below transverse hole 228 in bypass case 72.

A set of intermediate seals 236 are spaced below upper seals 234 and also seal on second outside diameter 230 of mandrel 212. An annular recess 238 extends outwardly from first bore 232 of bottom adapter 78. Recess 238 is longitudinally positioned below intermediate seals 236. A transverse hole 240 provides communication between recess 238 and well annulus 44. A set of lower seals 242 is positioned below recess 238 and also provides sealing engagement between bottom adapter 78 and second outside diameter 230 of mandrel 212.

Mandrel 212 has first and second check valve ports 244 and 246 angularly disposed therein. First and second check valve ports 244 and 246 are preferably angularly displaced from one another about a central longitudinal axis of packer bypass 10 at approximately 180°. A first ball check valve 248 is positioned in first check valve port 244, and a first valve retainer 250 is threaded into the first check valve port to hold the first ball check valve in place and act as a seat therefor. A first check valve spring 252 biases first ball check valve 248 into sealing engagement with first valve retainer 250. Similarly, a second ball check valve 254 is held in place by, and normally seated against, a second valve retainer 256 which is threaded into second check valve portion 246, and a second check valve spring 258 biases second ball check valve 254 into sealing engagement with second valve retainer 256.

Extending downwardly from first check valve port 244 below first ball check valve 248 is a substantially longitudinal port 260 with a transverse port 262 intersecting the lower end thereof. It will be seen that, in the position of mandrel 212 shown in FIGS. 2C and 2D, transverse port 262 opens toward first bore 232 of bottom adapter 78 of case means 50 at a longitudinal position between upper seals 234 and intermediate seals 236.

Extending downwardly from second check valve port 246 below second ball check valve 254 is an angularly disposed port 264. It will be seen that port 264 opens on the radially inner side of mandrel 212 toward inner flow tube 88.

Mandrel 212 has a first bore 266, a second bore 268 spaced radially inwardly from first bore 266, and a third bore 270 larger than second bore 268. A sealing means, such as a set of inner seals 272 is disposed on second bore 268 of mandrel 212. In the position shown in FIGS. 2C and 2D, it will be seen that seals 272 are radially outwardly spaced from fourth outside diameter 208 of inner flow tube 88 so that there is no sealing engagement between the inner flow tube and mandrel 212. It will also be seen that inner seals 272 are positioned above the intersection of angularly disposed port 264 with second bore 268 of mandrel 212.

A substantially transverse hole 274 extends through mandrel 212 from third bore 270 thereof. In the position shown in FIGS. 2C and 2D, hole 274 is positioned below lower seals 242 in bottom adapter 78 of case means 50.

Figure 5:
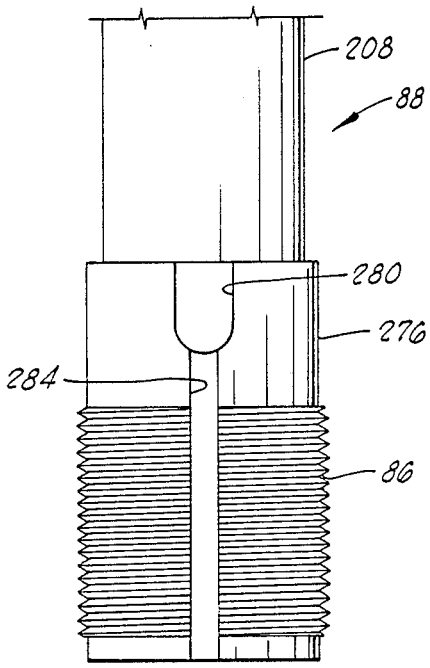
FIG. 5 shows an elevation of a lower end of a flow tube in the packer bypass.

Referring now to FIGS. 2D and 5, the lower end of inner flow tube 88 is shown. Inner flow tube 88 includes a fifth outside diameter 276 which is generally adjacent and facing annular recess 278 in bottom adapter 78. A recess or notch 280 is formed in fifth outside diameter 276 of inner flow tube 88, and it will be seen that this insures fluid communication between recess 278 and annular passageway 90 along second bore 282 of bottom adapter 78. Another flow passageway 284 formed in fifth outside diameter 276 and threaded portion 86 of inner flow tube 88 insures fluid communication between annular recess 278 and the components of testing apparatus 12 attached below packer bypass 10, including upper packer 34 and lower packer 36. As will be discussed in greater detail herein, communication is thus provided to the packers for inflation and deflation thereof.

Inner flow tube 88 further includes a second bore 285 at the lower end thereof. Second bore 285 is adapted for receiving a mandrel (not shown) of a kind known in the art which is included in the portion of testing apparatus 12 below packer bypass 10.

OPERATION OF THE INVENTION

As testing apparatus 12 is lowered into well bore 14 on tool string 18, packer bypass 10 is preferably in the position shown in FIGS. 2A–2D. That is, piston means 56 is in the uppermost position with respect to case means 50, and mandrel means 54 is in the lowermost position with respect to case means 50. When testing apparatus 12 is in the position shown in FIGS. 1A and 1B with upper packer 34 and lower packer 36 located properly with respect to well formation 16, pump 26 is operated to inflate the packers. Fluid is pumped from well annulus 44 downwardly through an annular passageway in testing apparatus 12. A part of this annular passageway passes through packer bypass 10 and includes annular cavity 122, hole 128, annular cavity 126, an upper portion 286 of annular passageway 90 above mandrel 212, annular space 288 between mandrel 212 and inner flow tube 88, a lower portion 290 of annular passageway 90 below mandrel 212, notch 280, recess 278 and flow passageway 284.

When fluid is being pumped from pump 26 to packers 34 and 36 through packer bypass 10, first and second ball check valves 248 and 254 are in their closed positions. It will be seen that transverse hole 228 through bypass case 72 of case means 50 is sealed by seals 226 on mandrel 212 and upper seals 234 on bottom adapter 78. Thus, fluid communication between annular passageway 90 in packer bypass 10 and well annulus 44 through hole 228 is prevented.

Similarly, transverse hole 240 in bottom adapter 78 of case means 50 is sealed by intermediate seals 236 and lower seals 242 on bottom adapter 78, again preventing fluid communication between annular passageway 90 and well annulus 44 through hole 240.

Once upper packer 34 and lower packer 36 are inflated, a test on well formation 16 may be carried out in a manner known in the art. After the test, it is necessary to deflate packers 34 and 36 so that testing apparatus 12 may be removed from well bore 14 or moved to another position in the well bore for testing a different well formation. To accomplish this, weight is set down on testing string 18 so that piston means 56 is moved downwardly with respect to case means 50 to the position shown in FIGS. 6A–6D. As this occurs, of course, splines 158 on splined mandrel 146 slide downwardly with respect to splines 160 in splined nipple 68.

As soon as latching fingers 178 are moved below chamfered surface 190 in splined nipple 68, garter springs 194 act to pivot the lower ends of latching fingers 178 inwardly. Over-pivotation is prevented by the contact of inner surface 292 of latching fingers 178 with outer surface 294 of latching assembly mandrel 170, as best shown in FIG. 6C.

When piston means 56 and latching means 168 are moved to the lowermost position shown in FIG. 6C, chamfered surface 200 on the lower end of each latching finger 178 engages flange 220 on the upper end of mandrel 212 so that the lower ends of the latching fingers are again pivoted outwardly until all teeth 196 pass below flange 220, at which point garter springs 194 will snap the lower ends of latching fingers 178 inwardly, so that the latching fingers are in a latching position with teeth 196 thereon positioned below flange 220 on mandrel 212, and flange 220 extends into notch 198 on each latching finger 178.

Downward movement of piston means 56 with respect to case means 50, and thus the downward movement of latching means 168 with respect to mandrel means 54, is limited by the engagement of lower end 296 of top adapter 92 with upper end 298 of hydraulic case 58. This is best seen in FIG. 6A.

Further, as piston means 56 is moved downwardly with respect to case means 50, fluid in piston chamber 162 is displaced through hole 66 in hydraulic case 58 to well annulus 44. In other words, the volume of piston chamber 162 is reduced. Simultaneously, an upper piston chamber 300 is annularly formed between hydraulic piston 100 and hydraulic case 58 and longitudinally between the shoulder 64 on hydraulic case and shoulder 142 on the hydraulic piston. The volume of upper piston chamber 300 increases as piston means 56 is moved downwardly. Fluid is allowed to enter upper piston chamber 300 through hole 144 in hydraulic piston 100.

Once latching means 168 is latchingly engaged with mandrel means 54, the mandrel means may be raised to an open, bypassing position by lifting on tool string 18 and thus raising piston means 56, and mandrel means 54 latched thereto, with respect to case means 50. When piston means 56 is returned to the uppermost position thereof at which point shoulder 142 on hydraulic piston 100 again contacts shoulder 64 in hydraulic case 58, mandrel means 54 is raised to the uppermost position thereof, as best shown in FIGS. 7A–7D.

It will be seen by those skilled in the art that downwardly facing shoulder 231 defines an annular differential area on mandrel 212 with pump pressure thereabove and well annulus pressure therebelow. Shoulder 231 is preferably sized such that, prior to upward movement of mandrel 212, an upward pull of approximately 10,000 pounds on tool string 18 is required to move the mandrel. Upward movement of tool string 12 is required during a testing operation to actuate tester valve 22, and obviously, it would be undesirable to prematurely relieve the pressure in packers 34 and 36. Therefore, this requirement of 10,000 pounds overpull provides an overpull prevention means so that packer bypass 10 cannot be inadvertently opened during a normal test.

As piston means 56, and mandrel means 54 latched thereto, are moved upwardly, seals 272 on mandrel 212 sealingly engage third outside diameter 206 of inner flow tube 88. This causes second ball check valve 254 to open to maintain an equal pressure in upper portion 286 and lower portion 290 of annular passageway 90.

As transverse port 262 in mandrel 212 is moved above upper seals 234 on bottom adapter 78 of case means 50, first ball check valve 248 will open. As this occurs, the pressure in annular flow passageway 90 will drop rapidly to well annulus pressure, and the force required to raise mandrel 212 will drop accordingly since the pressure across the annular area of shoulder 231 will be essentially balanced.

Continued upward movement of piston means 56 and mandrel 212 will stop when shoulder 142 on hydraulic piston 100 engages shoulder 64 in hydraulic case 58. At this point, piston means 56 and mandrel means 54 are in the position shown in FIGS. 7A–7D. Chamfered surface 188 on latching fingers 178 again contacts chamfered surface 190 at the lower end of splined nipple 68, acting as a releasing means so that the lower end of latching fingers 68 are again pivoted radially outwardly such that teeth 196 are disengaged from flange 220 on mandrel 212.

In the raised position of mandrel 212, it will be seen that annular cavity 231 between second outside diameter 230 of mandrel 212 and inner bore 224 of bypass case 72 is enlarged. Transverse port 262 at the lower end of longitudinal port 260 is raised above upper seals 234 and placed in communication with annular cavity 231 and hole 228 in bypass case 72, and thus also in communication with well annulus 44.

First check valve 252 stays open, and pump pressure above mandrel 212 is bypassed through packer bypass 10 past first ball check valve 248 and through longitudinal port 260, transverse port 262, annular cavity 231 and hole 228 to well annulus 44.

Simultaneously, transverse hole 274 in mandrel 212 is raised to a position between intermediate seals 236 and lower seals 242 in bottom adapter 78 of case means 50. In this position, transverse hole 274 is thus placed in communication with recess 238 and hole 240 in bottom adapter 78, and thus in communication with well annulus 44.

Because of the sealing engagement of inner seals 272 with third outside diameter 206 of inner flow tube 88, lower portion 290 of annular passageway 90 below inner seals 272 is sealingly separated from upper portion 286 of annular passageway 90 above mandrel 212. In other words, annular space 288 is closed off.

The pressure in packers 34 and 36 is relieved upwardly through the portion of testing apparatus 12 below packer bypass 10 and through flow passageway 284, recess 278, notch 280 to lower portion 290 of annular passageway 90 below inner seals 272. Thus, the inflation chambers of packers 34 and 36 are in communication with hole 274 in mandrel 212, recess 238 and hole 240 in bottom adapter 78, and thus are in bypassing, deflating communication with well annulus 44.

After deflation of packers 34 and 36 by bypassing through packer bypass 10 as above described, testing apparatus 12 may be moved within well bore 14. If it is desired to retest well formation 16 or move testing apparatus 12 for testing another well formation, packer bypass 10 will automatically reset to the position shown in FIGS. 2A–2D when pump pressure is applied by pump 26. As fluid pressure in upper portion 286 of annular passageway 90 above mandrel 212 increases, the pump pressure acting upon the top of mandrel 212 will cause the mandrel to move downwardly to its lowermost position. First check valve spring 252 and second check valve spring 258 are sized such that first ball check valve 248 and second ball check valve 254, respectively, will not open before mandrel 212 is repositioned in the downwardmost, closed position. Once mandrel 212 is again at the downwardmost position, the entire cycle may be repeated.

It will be seen, therefore, that the packer bypass of the present invention is well adapted to carry out the ends and advantages mentioned, as well as those inherent therein. While a presently preferred embodiment of the invention has been described for the purposes of this disclosure, numerous changes in the arrangement and construction of parts may be made by those skilled in the art. All such changes are encompassed within the scope and spirit of the appended claims.

What is claimed is:

1. A packer bypass apparatus for use in a testing string having a pump in an upper testing string portion and a packer in a lower testing string portion, said bypass apparatus comprising:

a case adapted for attachment to said lower testing string portion and having a longitudinally central opening therethrough with at least one transverse port therein;

an inner flow tube disposed in said central opening of said case such that said case and said flow tube define a substantially annular flow passageway therebetween in communication with said packer;

a bypass mandrel reciprocably disposed in said flow passageway and movable between an open and a closed position, said mandrel defining a bypass passageway therein for providing communication between said flow passageway and a well annulus when in said open position;

a piston having an upper portion adapted for attachment to said upper testing string portion and a lower portion disposed in said flow passageway above said mandrel and reciprocable between a first position and a second position; and latching means on said lower portion of said piston for latchingly engaging said mandrel in said closed position when said piston is moved to said second position, whereby said mandrel may be moved from said closed position to said open position as said piston is moved from said second position to said first position, said latching means comprising:

a latch pivotally attached to said lower portion of said piston, said latch comprising a lower end having a latching position and a released position; and biasing means for biasing said lower end of said latch toward said latching position.

2. The apparatus of claim 1 wherein:

said latch is one of a plurality of angularly spaced latches; and said biasing means comprises a garter spring disposed around said latches.

3. The apparatus of claim 1, wherein said releasing means comprises a tapered surface in said case for engaging an upper end of said latch and pivoting said lower end of said latch to said released position.

4. A packer bypass apparatus for use in a testing string having a pump in an upper testing string portion and a packer in a lower testing string portion, said bypass apparatus comprising:

a case adapted for attachment to said lower testing string portion and having a longitudinally central opening therethrough with at least one transverse port therein;

an inner flow tube disposed in said central opening of said case such that said case and said flow tube define a substantially annular flow passageway therebetween in communication with said packer;

a bypass mandrel reciprocably disposed in said flow passageway and movable between an open and a closed position, said mandrel defining a bypass passageway therein for providing communication between said flow passageway and a well annulus when in said open position;

sealing means for sealing between said mandrel and said flow tube when said mandrel is in said open position whereby said flow passageway is separated into upper and lower portions;

check valve means for venting said upper portion of said flow passageway through said bypass passageway in said mandrel when a differential pressure between said upper portion of said flow passageway and said well annulus exceeds a predetermined level;

a piston having an upper portion adapted for attachment to said upper testing string portion and a lower portion disposed in said flow passageway above said mandrel and reciprocable between a first position and a second position; and latching means on said lower portion of said piston for latchingly engaging said mandrel in said closed position when said mandrel is moved to said second position, whereby said mandrel may be moved from said closed position to said open position as said piston is moved from said second position to said first position.

5. A packer bypass apparatus for use in a testing string with a pump and an inflatable packer, said apparatus comprising:

case means defining a central opening therethrough;

piston means reciprocably disposed in said central opening of said case means and movable between a first position and a second position;

mandrel means disposed in said central opening of said case means and having a bypass position for providing communication between said packer and a well annulus and further having a sealed position preventing communication between said packer and said well annulus, wherein said mandrel means is movable from said bypass position to said sealed position in response to a differential pressure between said pump and said well annulus acting across a portion of said mandrel means; and pivotable latching means in operative association with said piston means for latchingly engaging said mandrel means when said mandrel means is in said sealed position and said piston means is in said second position, whereby said mandrel means may be moved from said sealed position to said bypass position by moving said piston means from said second position to said first position.

6. A packer bypass apparatus for use in a testing string with a pump and an inflatable packer, said apparatus comprising:

case means defining a central opening therethrough;

piston means reciprocably disposed in said central opening of said case means and movable between a first position and a second position;

mandrel means disposed in said central opening of said case means and having a bypass position for providing communication between said packer and a well annulus and further having a sealed position preventing communication between said packer and said well annulus;

pivotable latching means in operative association with said piston means for latchingly engaging said mandrel means when said mandrel means is in said sealed position and said piston means is in said second position, whereby said mandrel means may be moved from said sealed position to said bypass position by moving said piston means from said second position to said first position; and overpull prevention means for preventing movement of said mandrel means until a predetermined force is overcome, wherein said overpull prevention means is characterized by a differential area on said mandrel means, said area being exposed to pump pressure on one side thereof and well annulus pressure on an opposite side thereof.

7. A packer bypass apparatus for use in a testing string with a pump and an inflatable packer, said apparatus comprising:

case means defining a central opening therethrough;

piston means reciprocably disposed in said central opening of said case means and movable between a first position and a second position;

mandrel means disposed in said central opening of said case means and having a bypass position for providing communication between said packer and a well annulus and further having a sealed position preventing communication between said packer and said well annulus;

pivotable latching means in operative association with said piston means for latchingly engaging said mandrel means when said mandrel means is in said sealed position and said piston means is in said second position, whereby said mandrel means may be moved from said sealed position to said bypass position by moving said piston means from said second position to said first position; and pressure balancing means for balancing pressure between said case means and said piston means for minimizing downward force on said packer.

8. A packer bypass apparatus for use in a testing string with a pump and an inflatable packer, said apparatus comprising:

case means defining a central opening therethrough;

piston means reciprocably disposed in said central opening of said case means and movable between a first position and a second position;

mandrel means disposed in said central opening of said case means and having a bypass position for providing communication between said packer and a well annulus and further having a sealed position preventing communication between said packer and said well annulus;

pivotable latching means in operative association with said piston means for latchingly engaging said mandrel means when said mandrel means is in said sealed position and said piston means is in said second position, whereby said mandrel means may be moved from said sealed position to said bypass position by moving said piston means from said second position to said first position; and inner flow tube means disposed in said case means such that an annular flow passageway is defined between said case means and said flow tube means;

wherein:

said piston means has an annular portion disposed in said flow passageway; and said mandrel means is characterized by a generally annular mandrel disposed in said flow passageway.

9. A packer bypass apparatus for use in a testing string having a pump in an upper testing string portion and a packer in a lower testing string portion, said bypass apparatus comprising:

a case adapted for attachment to said lower testing string portion and having a longitudinally central opening therethrough with at least one transverse port therein;

an inner flow tube disposed in said central opening of said case such that said case and said flow tube define a substantially annular flow passageway therebetween in communication with said packer;

a bypass mandrel reciprocably disposed in said flow passageway and movable between an open and a closed position, said mandrel defining a bypass passageway therein for providing communication between said flow passageway and a well annulus when in said open position;

a piston having an upper portion adapted for attachment to said upper testing string portion and a lower portion disposed in said flow passageway above said mandrel and reciprocable between a first position and a second position; and pivotable latching means on said lower portion of said piston for latchingly engaging said mandrel in said closed position when said piston is moved to said second position, whereby said mandrel may be moved from said closed position to said open position as said piston is moved from said second position to said first position, wherein said mandrel defines an annular shoulder thereon and movement of said mandrel from said closed position to said open position is prevented until an upward force on said piston latched to said mandrel exceeds a downward force on said mandrel due to a differential pressure between said flow passageway above said mandrel and said well annulus acting across an area defined by said shoulder.

10. A packer bypass apparatus for use in a testing string having a pump in an upper testing string portion and a packer in a lower testing string portion, said bypass apparatus comprising:

a case adapted for attachment to said lower testing string portion and having a longitudinally central opening therethrough with at least one transverse port therein;

an inner flow tube disposed in said central opening of said case such that said case and said flow tube define a substantially annular flow passageway therebetween in communication with said packer;

a bypass mandrel reciprocably disposed in said flow passageway and movable between an open and a closed position, said mandrel defining a bypass passageway therein for providing communication between said flow passageway and a well annulus when in said open position;

a piston having an upper portion adapted for attachment to said upper testing string portion and a lower portion disposed in said flow passageway above said mandrel and reciprocable between a first position and a second position;

pivotable latching means on said lower portion of said piston for latchingly engaging said mandrel in said closed position when said piston is moved to said second position, whereby said mandrel may be moved from said closed position to said open position as said piston is moved from said second position to said first position; and pressure balancing means between said piston and said case for balancing pump pressure acting on said case for minimizing a downward force on said case and said packer.

11. The apparatus of claim 10 wherein said pressure balancing means includes:

a recess defined in said case; and an annular shoulder on said piston extending into said recess such that a cavity is formed therebetween with an upper portion in communication with said pump and a lower portion in communication with said well annulus.

12. A downhole testing tool comprising:

a pump attached to an upper testing string portion;

an inflatable packer disposed below said pump and positionable adjacent a well formation to be tested; and a packer bypass disposed between said pump and packer for allowing communication between said pump and packer when in a closed position and venting said pump and packer to a well annulus when in an open position, said packer bypass comprising:

a case;

a reciprocable mandrel disposed in said case and having closed and open positions corresponding to said closed and open positions of said packer bypass;

releasable pivoting latching means vertically movable with said upper testing string portion and latchingly engageable with said mandrel when in said closed position, whereby said mandrel may be moved to said open position and released at said open position; and overpull prevention means for preventing premature movement of said mandrel to said open position, wherein:

said overpull prevention means includes an annular area defined on said mandrel, and a differential pressure between said pump and well annulus acts against said area for providing a downward force on said mandrel.

* * * * *